US009242143B2

(12) United States Patent
Cole et al.

(10) Patent No.: US 9,242,143 B2
(45) Date of Patent: Jan. 26, 2016

(54) PROPRIOCEPTION TRAINING AND EXERCISE APPARATUS

(71) Applicant: iStep Global, LLC, Encinitas, CA (US)

(72) Inventors: John Cole, Encinitas, CA (US); David C. Pratson, Bonsall, CA (US); Tien Le, Oceanside, CA (US); Axel Mnich; Jeff Harlan, Corona, CA (US)

(73) Assignee: iStep Global, LLC, Encinitas, CA (US)

( * ) Notice: Subject to any disclaimer, the term of this patent is extended or adjusted under 35 U.S.C. 154(b) by 0 days.

(21) Appl. No.: 14/271,341

(22) Filed: May 6, 2014

(65) Prior Publication Data

US 2014/0302974 A1 Oct. 9, 2014

Related U.S. Application Data

(63) Continuation of application No. 13/839,123, filed on Mar. 15, 2013, now Pat. No. 8,753,252, which is a continuation of application No. 12/942,841, filed on Nov. 9, 2010, now Pat. No. 8,460,161, which is a (Continued)

(51) Int. Cl.
*A63B 22/04* (2006.01)
*A63B 26/00* (2006.01)
(Continued)

(52) U.S. Cl.
CPC ..... *A63B 26/003* (2013.01); *A63B 21/0552* (2013.01); *A63B 21/068* (2013.01);
(Continued)

(58) Field of Classification Search
CPC ..... A63B 26/003; A63B 21/0552; A63B 21/068; A63B 23/03541; A63B 23/0458; A63B 23/12; A63B 23/1236; A63B 71/0009; A63B 71/0054
See application file for complete search history.

(56) References Cited

U.S. PATENT DOCUMENTS 2,761,155 A 9/1956 Headley
2,978,243 A 4/1961 Gabrielson
(Continued)

FOREIGN PATENT DOCUMENTS

JP 02-109662 9/1990
JP 2005-507291 3/2005
(Continued)

OTHER PUBLICATIONS

Office action issued on Aug. 21, 2009 in related U.S. Appl. No. 12/075,322, now U.S. Pat. No. 7,722,506.
(Continued)

*Primary Examiner* — Glenn Richman
(74) *Attorney, Agent, or Firm* — Charles F. Reidelbach, Jr., Esq.

(57) ABSTRACT

An exercise apparatus includes a substantially flat, rigid platform for supporting a user during exercise. An inflatable tubular support having an upper portion with a first radial outside diameter, and a lower portion with a second radial outside diameter that is greater than the first radial outside diameter, is coupled to the platform by a fastener. The tubular support defines a central opening that communicates between the platform and a support surface. The platform includes a venting structure for releasing air from the central opening during use. The inflatable support includes an intermediate portion between the upper portion and the lower portion of the tubular support, the intermediate portion including a support feature to restrain the intermediate portion from radial expansion induced by an air pressure internal to the integral inflatable support.

16 Claims, 11 Drawing Sheets

Related U.S. Application Data continuation-in-part of application No. 12/632,691, filed on Dec. 7, 2009, now Pat. No. 8,632,440, which is a continuation-in-part of application No. 12/075,322, filed on Mar. 10, 2008, now Pat. No. 7,722,506.

(60) Provisional application No. 60/905,969, filed on Mar. 10, 2007.

(51) Int. Cl.

| | |
|---|---|
| ***A63B 21/055*** | (2006.01) |
| ***A63B 21/068*** | (2006.01) |
| ***A63B 22/18*** | (2006.01) |
| ***A63B 23/035*** | (2006.01) |
| ***A63B 23/04*** | (2006.01) |
| ***A63B 23/12*** | (2006.01) |
| *A63B 71/00* | (2006.01) |
| *A63B 22/00* | (2006.01) |

(52) U.S. Cl.

CPC ..... *A63B 22/18* (2013.01); *A63B 23/03541* (2013.01); *A63B 23/0458* (2013.01); *A63B 23/12* (2013.01); *A63B 23/1236* (2013.01); *A63B 71/0009* (2013.01); *A63B 71/0054* (2013.01); *A63B 2022/0033* (2013.01); *A63B 2208/12* (2013.01); *A63B 2225/62* (2013.01)

(56) References Cited

U.S. PATENT DOCUMENTS

| | | | |
|---|---|---|---|
| 3,095,947 | A | 7/1963 | Beaulaurier |
| 3,125,377 | A | 3/1964 | Bridges |
| 3,167,312 | A | 1/1965 | Blanchard |
| 4,021,873 | A | 5/1977 | Francois |
| 4,159,826 | A | 7/1979 | Hancock |
| 4,516,767 | A | 5/1985 | Eskijian |
| 4,516,768 | A | 5/1985 | Gallaro |
| 4,817,950 | A | 4/1989 | Goo |
| 5,112,045 | A | 5/1992 | Mason et al. |
| 5,297,978 | A | 3/1994 | Ramsey |
| 5,441,466 | A | 8/1995 | Piaget et al. |
| 5,575,738 | A | 11/1996 | Millington et al. |
| 5,637,057 | A | 6/1997 | Collura |
| 5,813,946 | A | 9/1998 | Lin et al. |
| 6,015,471 | A | 1/2000 | Rimington et al. |
| 6,024,678 | A | 2/2000 | Solomon |
| 6,422,983 | B1 | 7/2002 | Weck |
| 6,554,753 | B1 | 4/2003 | Weck et al. |
| 6,575,885 | B1 | 6/2003 | Weck et al. |
| 6,659,914 | B2 | 12/2003 | Plante |
| D489,423 | S | 5/2004 | Fan et al. |
| 7,160,229 | B2 | 1/2007 | Park |
| 7,306,550 | B2 | 12/2007 | Lin |
| 7,344,487 | B2 | 3/2008 | Carter et al. |
| 7,344,488 | B2 | 3/2008 | Weck et al. |
| 7,382,332 | B2 | 6/2008 | Essig et al. |
| 7,468,025 | B2 | 12/2008 | Hauser et al. |
| 7,494,446 | B2 | 2/2009 | Weck et al. |
| 7,553,267 | B1 | 6/2009 | Hauser et al. |
| 7,601,107 | B2 | 10/2009 | Maloy et al. |
| D627,015 | S | 11/2010 | Senegal |
| 2004/0023766 | A1 | 2/2004 | Slone |
| 2004/0110609 | A1 | 6/2004 | Huang |
| 2005/0009677 | A1 | 1/2005 | Yang |
| 2005/0049123 | A1 | 3/2005 | Dalebout et al. |
| 2005/0148433 | A1 | 7/2005 | Wang et al. |
| 2005/0227838 | A1 | 10/2005 | Friesen |
| 2009/0227427 | A1 | 9/2009 | Park |
| 2010/0029443 | A1 | 2/2010 | Kim |

FOREIGN PATENT DOCUMENTS

| | | |
|---|---|---|
| JP | 2006-095132 | 4/2006 |
| WO | 03/037445 | 5/2003 |
| WO | 2005/057620 | 6/2005 |

OTHER PUBLICATIONS

Office action issued on Oct. 15, 2010 in related U.S. Appl. No. 12/632,691.

Office action issued on Jun. 28, 2011 in related U.S. Appl. No. 12/632,691.

Office action issued on Mar. 7, 2012 in related U.S. Appl. No. 12/632,691.

Office action issued on Apr. 3, 2013 in related U.S. Appl. No. 12/632,691.

Advisory action issued on Jun. 14, 2013 in related U.S. Appl. No. 12/632,691.

Office action issued on Jul. 5, 2012 in related U.S. Appl. No. 12/942,841, now U.S. Pat. No. 8,460,161.

Written Opinion of the International Searching Authority issued on Jun. 20, 2008 in related PCT application No. PCT/US2008/003144.

Examiner's report issued on Nov. 30, 2011 in related Australian patent application No. 2008226901, now Patent No. 2008226901.

Office action issued on Nov. 30, 2010 in related Chinese patent application No. 200880007883.1, now U.S. Patent No. 200880007883.1.

Supplementary European Search Report issued on May 7, 2012 in related European patent application No. 08726643.3.

Office action issued on Aug. 24, 2012 in related Japanese patent application No. 2009-553594.

Examination report issued on Jun. 5, 2012 in related New Zealand patent application No. 579563, now U.S. Pat. No. 579563.

Examination report issued on Feb. 8, 2012 in related Mexican patent application No. MX/a/2009/009625, now U.S. Pat. No. 299613.

Office action issued on Feb. 7, 2014 in related Canadian patent application No. 2680271.

PROPRIOCEPTION TRAINING AND EXERCISE APPARATUS

CROSS REFERENCE TO RELATED APPLICATIONS

This application is a continuation of U.S. application Ser. No. 13/839,123 filed on Mar. 15, 2013, which is a continuation of U.S. application Ser. No. 12/942,841 filed on Nov. 9, 2010, now U.S. Pat. No. 8,460,161, which is a continuation-in-part of U.S. application Ser. No. 12/632,691 filed on Dec. 7, 2009, now U.S. Pat. No. 8,632,440 which is a continuation-in-part of U.S. application Ser. No. 12/075,322 filed on Mar. 10, 2008, now U.S. Pat. No. 7,722,506, which claims the benefit of Provisional Application Ser. No. 60/905,969, filed on Mar. 10, 2007 and which are incorporated by reference.

FIELD OF THE INVENTION

The present invention is directed generally to exercise equipment. More specifically, but without limitation thereto, the present invention is directed to a apparatus for exercise and for proprioception training.

BACKGROUND OF THE INVENTION

Proprioception is the sense of the relative position of neighboring parts of the body. Unlike the six exteroceptive senses (sight, taste, smell, touch, hearing, and balance) by which we perceive the outside world, and interoceptive senses, by which we perceive the pain and movement of internal organs, proprioception is a third distinct sensory modality that indicates whether the body is moving with sufficient effort, as well as where the various parts of the body are located in relation to one another. A variety of devices have been developed for proprioception training for athletes and for rehabilitating patients recovering from injuries that affect movement and coordination.

SUMMARY OF THE INVENTION

In one embodiment, an exercise apparatus includes a substantially flat, rigid platform for supporting a user during exercise. An inflatable tubular support having an upper portion with a first radial outside diameter, and a lower portion with a second radial outside diameter that is greater than the first radial outside diameter, is coupled to the platform by a fastener. The tubular support defines a central opening that communicates between the platform and a support surface. The platform includes a venting structure for releasing air from the central opening during use. The inflatable support includes an intermediate portion between the upper portion and the lower portion of the tubular support, the intermediate portion including a support feature to restrain the intermediate portion from radial expansion induced by an air pressure internal to the integral inflatable support.

BRIEF DESCRIPTION OF THE DRAWINGS

The above and other aspects, features and advantages will become more apparent from the description in conjunction with the following drawings presented by way of example and not limitation, wherein identical reference indicia in separate views indicate the same elements and the same combinations of elements throughout the drawings, and wherein.

DETAILED DESCRIPTION OF ILLUSTRATED EMBODIMENTS

In the following detailed description of the preferred embodiments, reference is made to the accompanying drawings, which form a part hereof, and in which is shown by way of illustration specific embodiments in which the invention may be practiced. In this regard, directional terminology, such as "upper," "lower," "outward," "outside," "inward," etc., is used with reference to the orientation of the Figure(s) being described. The exercise apparatus and related components of the present invention can be positioned in a number of different orientations with an exemplary use as illustrated with respect to a support surface such as a floor or mat of a house, gymnasium, or exercise facility. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

The proprioceptive sense may be improved through exercises for athletes as well as for injured people undergoing rehabilitation. For example, juggling trains the mind for reaction time, spatial location, and efficient movement, and standing on a wobbly board or a balance board can re-train or increase proprioception abilities, especially as physical therapy for ankle or knee injuries. Accordingly, an exercise or balance apparatus is desirable that has both a cushioning effect during step exercising and an elevated substantially rigid platform that responds to the user's weight with unanticipated radial and vertical movement for proprioceptive input training. In addition, multiple exercise devices may be used in competition to play balance games.

An elastic resistance band is a portable alternative to weights for strength training. Several resistance band exercises have been devised to target specific muscle groups. Resistance band exercises are widely used by health and fitness practitioners for improving strength, conditioning, rehabilitation, and injury prevention. Disadvantageously, previous resistance band devices are typically connected by a heavy mount to the wall or floor, or they are held by the user's foot while in use, which may cause problems or injuries if it slips during an exercise. Accordingly, a step exerciser is desirable that provides a step aerobic apparatus with an elastic resistance band that may be used in combination to improve or rehabilitate proprioception.

Figure 1:
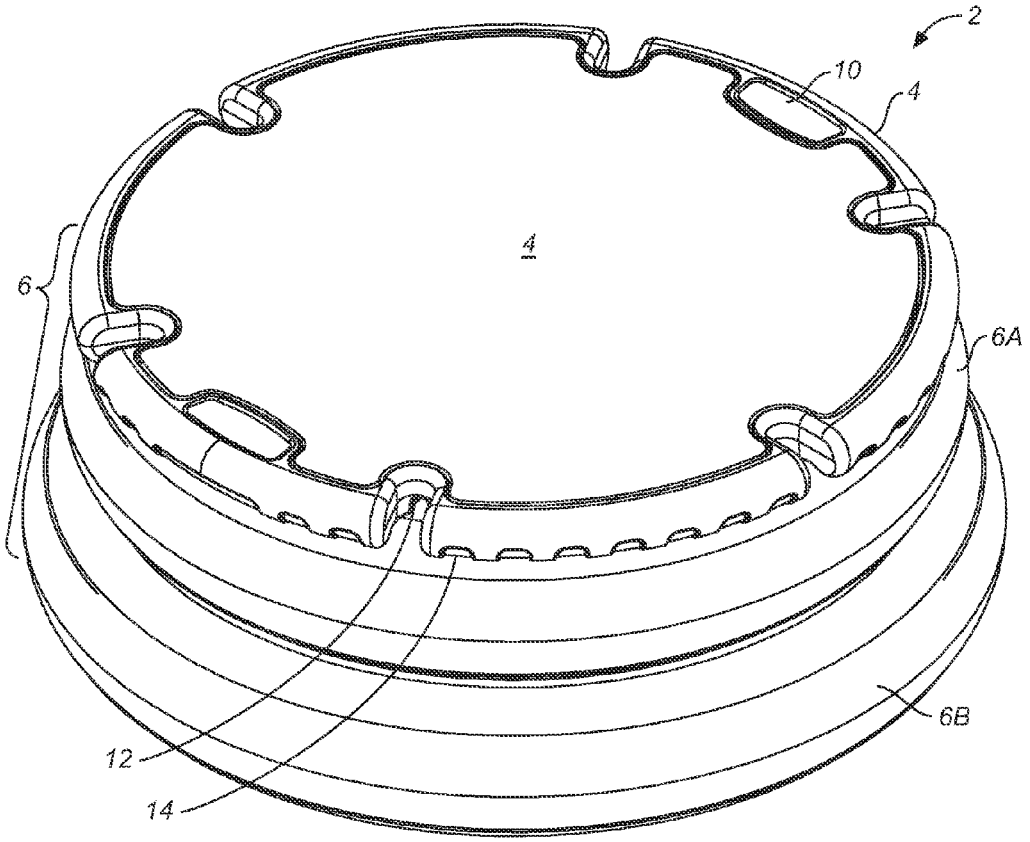
FIG. 1 illustrates a perspective view of an exercise apparatus with a flat, rigid platform supported on an upper tubular support and a lower tubular support.

FIG. 1 depicts a perspective or isometric view of an exercise apparatus 2 including a substantially rigid platform 4 supported by an inflatable support 6 on a support surface 8. Platform 4 is rigid or substantially rigid in construction so as to support a substantial portion (at least 20%, at least 30%, at least 50%, nearly 100%, 100%, or more than 100%) of a human body weight during physical exercise. Because the exercise generally involves motion, the actual force or impulse force on the platform 4 is a dynamic impulse, which may be greater than 100% of a human body weight during the physical exercise. The forces and impulses are also repetitive, so that it is important or critical that the platform be able to withstand repeated impulses whose magnitudes are such substantial portions of body weight. Platform 4 may be constructed of various sturdy substances such as wood, plastic, or metal. In a preferred embodiment, platform 4 is constructed of relatively high modulus injection or blow molded plastic and has features such as molded ribs to provide the necessary rigidity and durability.

Engaging and supporting the platform is the inflatable portion 6 that must similarly withstand such impulses and/or forces. In the illustrated embodiment of FIG. 1 the inflatable support includes two inflatable tubular portions including upper tubular portion 6A and lower tubular portion 6B. Platform 4 is engaged by and preferably attached to the upper tubular portion 6A. The lower tubular portion 6B is engaged by and preferably attached to the upper tubular support 6A. The lower tubular support 6B is engaged by and supported by support surface 8 which may the floor or mat of a room or exercise facility.

In one embodiment, platform 4 is rotatively mounted relative to inflatable support 6. Such may be accomplished by having a circular ball bearing race (not shown) that couples a bottom portion of platform 4 to a top portion of platform 4. Platform 4 may include lift handles 10 and accessory mounts 12. Platform 4 may also include vents 14 that couple to a venting structure or passage (described in detail with respect to FIGS. 16 and 17) to allow air to escape from an enclosed volume that is formed between a lower side of exercise apparatus 2 and support surface 8 when the enclosed volume is reduced.

Figure 2:
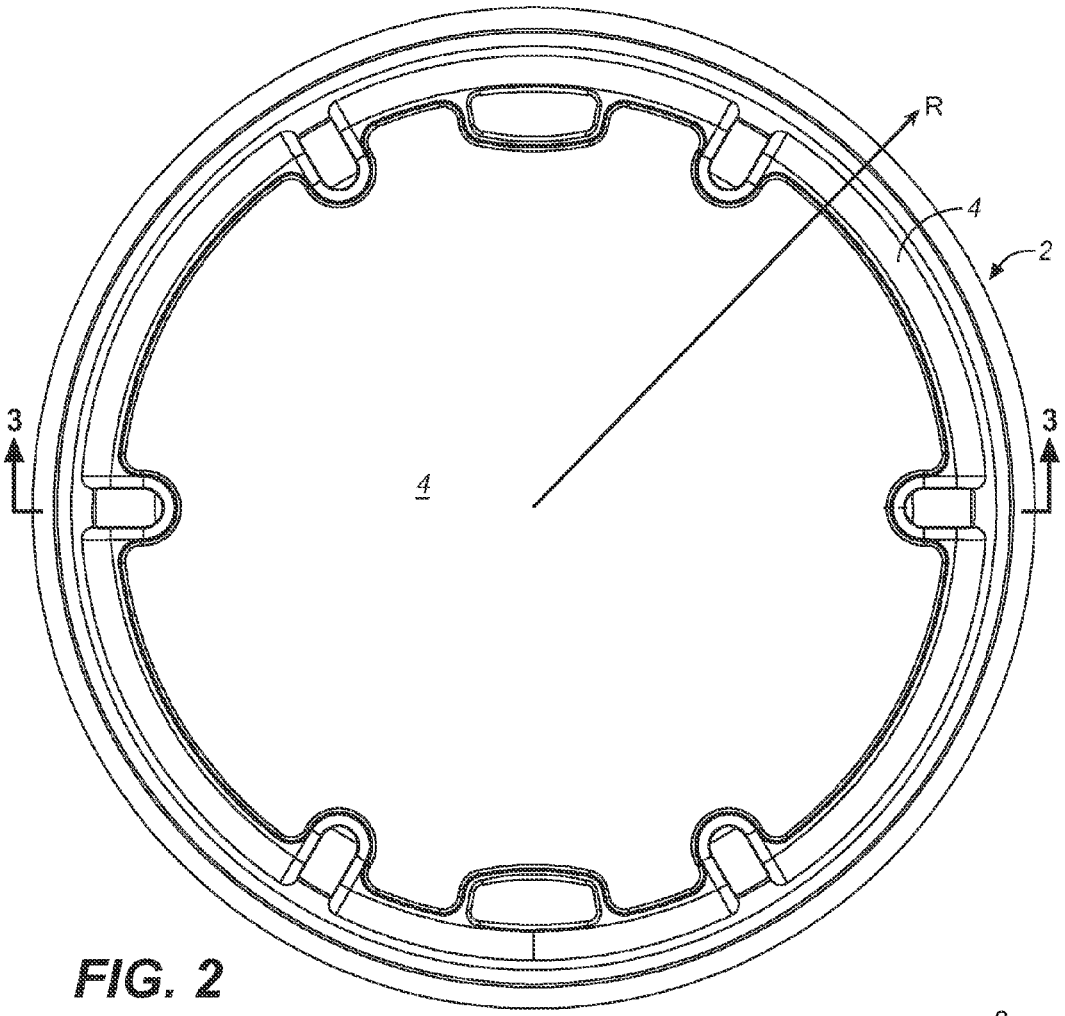
FIG. 2 illustrates a top view of the exercise apparatus of FIG. 1.
Figure 3:
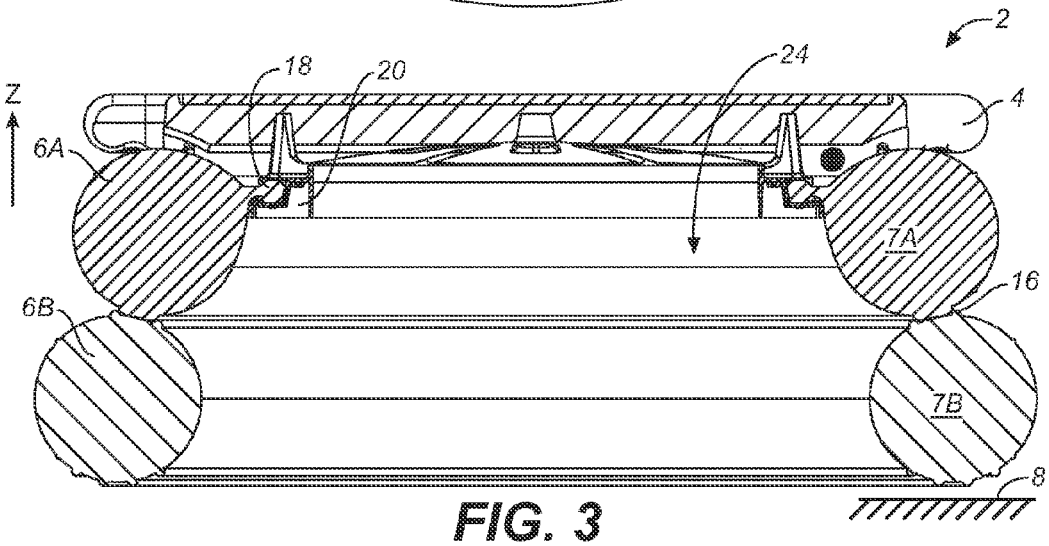
FIG. 3 illustrates a cross-sectional view through FIG. 2 of the exercise apparatus in FIG. 1.

FIG. 2 depicts a top view of exercise apparatus 2 including an indication of section lines 3-3. In the illustrated and preferred embodiment the overall shape of exercise apparatus 2 is circular but other shapes are contemplated by the invention such as oval, square, rectangular, or polygonal to name a few. In the discussion that follows, exercise apparatus 2 is described with respect to a cylindrical coordinate system including a radial direction R that points radially outward as depicted in FIG. 2 and a vertical axis that points in an upward direction Z as depicted in FIG. 3. Thus, a direction that is radially outward is in the direction R but a direction that is radially inward is in a direction opposite to R. A direction that is upward is in the direction Z but a direction that is downward is opposite to Z. Likewise an "upper portion" will be in the Z-direction relative to a "lower portion".

FIG. 3 depicts a cross sectional view of exercise apparatus 2 taken through the section lines 3-3 of FIG. 2. In the illustrated embodiment, a lower surface of lower tubular support 6B engages and is supported by support surface 8. An upper surface of lower tubular support 6B engages and supports a lower surface of upper tubular support 6A. Preferably the upper and lower tubular supports are bonded together along an annular bond zone 16. In one embodiment, they are bonded over zone 16 by an adhesive.

An upper surface of upper tubular support 6A engages and supports a lower surface of platform 4. Preferably upper tubular support is also coupled or attached to platform 4. In the illustrated embodiment, upper tubular support 6A includes an inwardly extending affixing member 18. A fastener 20 is utilized to attach affixing member 18 to platform 4 by capturing or sandwiching affixing member 18 to platform 4.

In the illustrated embodiment, tubular supports 6B and 6A are circular in cross section but other cross sectional shapes are possible such as elliptical, square, rectangular, or polygonal to name a few. Tubular supports 6B and 6A are preferably formed of an elastomeric polymer such as a rubber or another natural or synthetic polymer having suitable elastic properties. In a preferred embodiment, the supports are formed from PVC (polyvinyl chloride) with components such as a plasticizer to provide appropriate flexibility and elasticity. In one embodiment, the tubular supports 6B and 6A are separately and independently inflatable such that their inflation pressures may be optimized for particular physical exercises. In another embodiment they are coupled such that they are both inflated simultaneously.

In the illustrated embodiment upper tubular support 6A has an interior cavity 7A that is inflated with a first inflation pressure. Lower tubular support 6B has an interior cavity 7B that is separately inflated with a second inflation pressure wherein the second inflation pressure is different than the first inflation pressure.

Each of the tubular supports 6 includes a means for inflating (not shown) them such as a valve stem, needle valve or a self-sealing valve that allows a convenient method of inflation. Such means for inflation is also suitable for basketballs and other relatively high durability applications.

The inflatable support 6 generally has a central opening 24 defined by inflatable supports 6A and 6B. Between platform 4 and support surface 8 is an enclosed space or volume of air defined by central opening 24. The central opening 24 is in fluidic communication with vents 14 (FIG. 1) to allow air to escape through vents 14 when the enclosed space defined by opening 24 is reduced.

Figure 4:
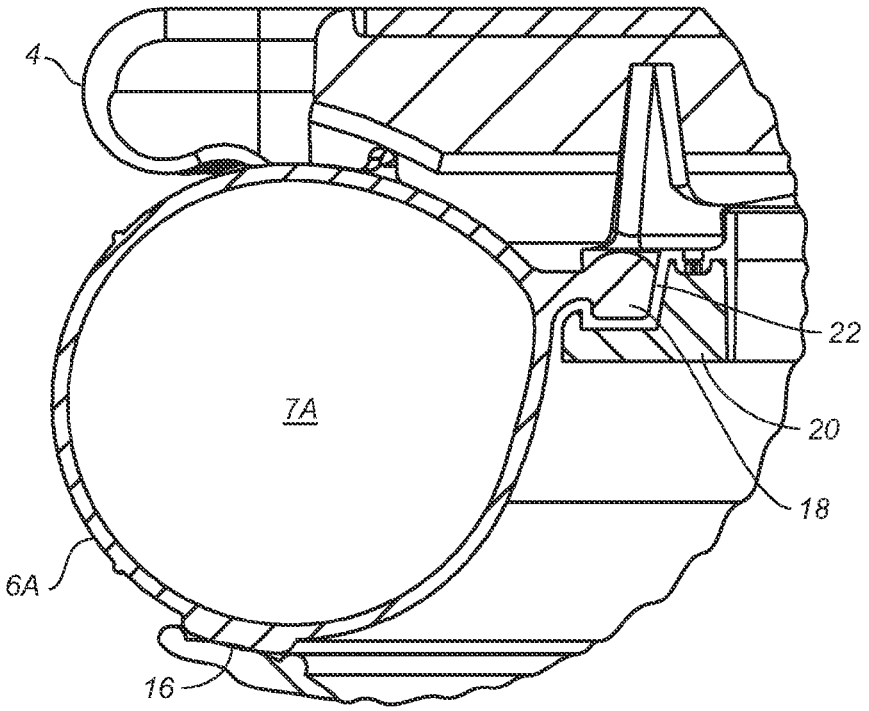
FIG. 4 is a magnified detail cross-sectional view taken from FIG. 3 and illustrating coupling an inflatable support to a rigid platform using a fastener.

FIG. 4 is a detailed view taken from FIG. 3 and depicts in greater detail an embodiment by which the upper tubular support 6A may be coupled to platform 4. According to FIG. 4, upper tubular support 6A includes an integral affixing member 18 that extends radially inward from a surface of tubular support 6A. Integral affixing member 18 includes a relatively wider portion and a relatively narrower portion that allows integral affixing member to be mechanically captured in an interlocking manner within a channel 22 formed between platform 4 and fastener 20. In a preferred embodiment, integral affixing member 18 is integrally formed with tubular support 6A. As depicted affixing member 18 is annular and generally ring shaped. Fastener 20 is an annular fastening ring. Annular affixing member 18 is captured in the annular channel 22 between platform 4 and fastener 20. Fastener 20 may be attached to platform using bolts, screws, mechanical snaps, adhesives, or conventional methods.

Figure 5:
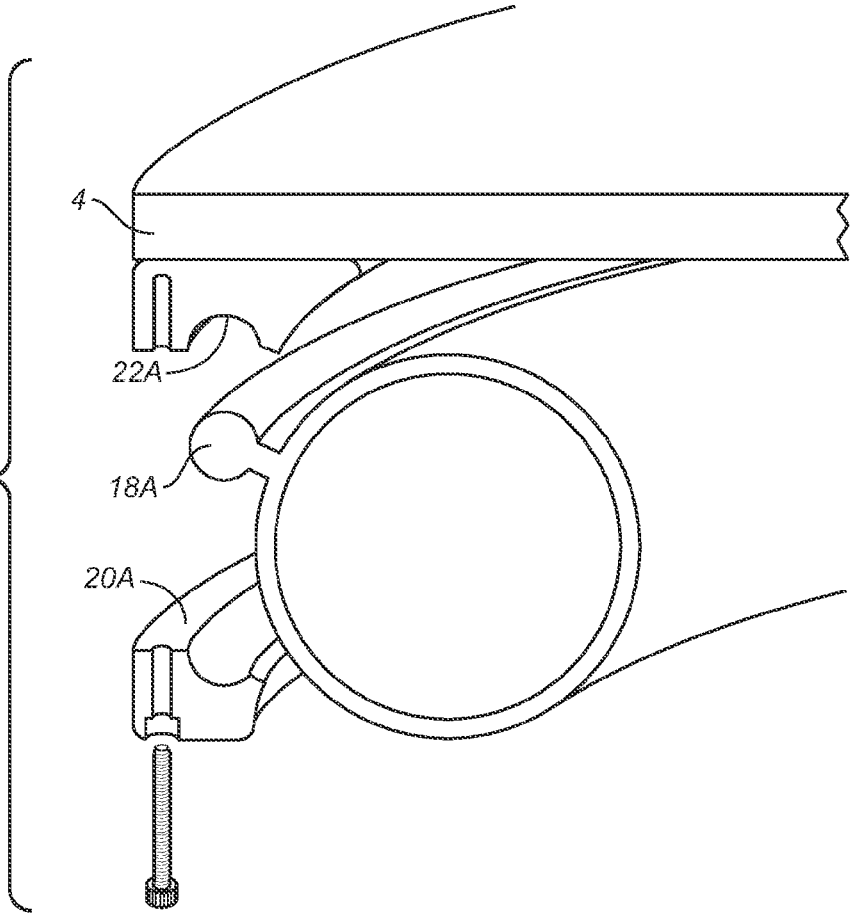
FIG. 5 is a magnified cross-sectional view illustrating an alternative way (relative to FIG. 4) of coupling an inflatable support to a platform using a fastener.

FIG. 5 is a detailed view similar to FIG. 4 and depicts an alternative embodiment by which tubular support 6A is coupled to platform 4. In this embodiment, integral affixing member 18A extends radially outward from a surface of tubular support 6A. An annular channel 22A is formed between platform 4 and ring shaped fastener 20A. Annular affixing member 18 A is captured in channel 22A when fastener 20A is coupled to platform 4. Fastener 20A may be may be attached to platform using bolts, screws, mechanical snaps, adhesives, or conventional methods.

Figure 6:
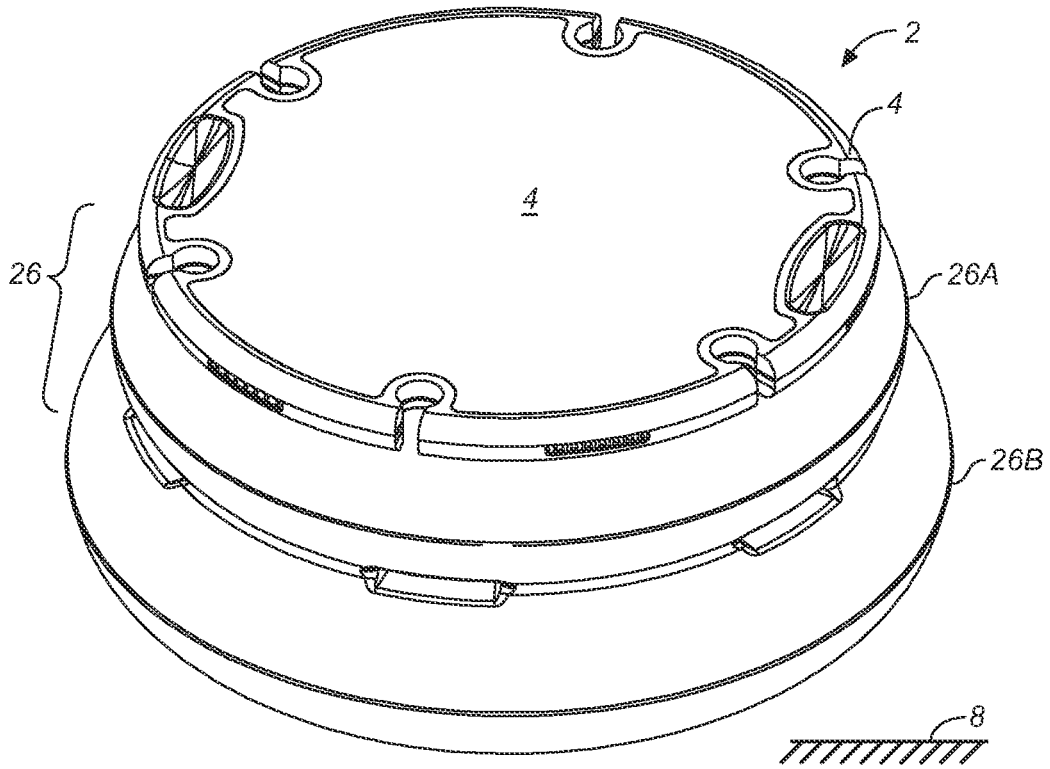
FIG. 6 illustrates a perspective view of a preferred embodiment of an exercise apparatus utilizing an integrally formed inflatable support 26.
Figure 7:
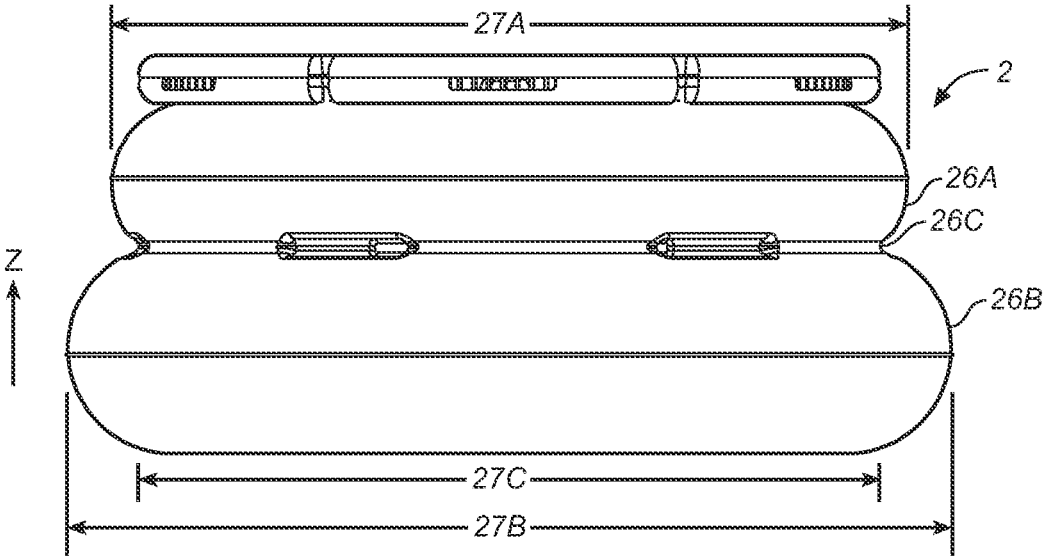
FIG. 7 illustrates a side view of the exercise apparatus of FIG. 6.

FIGS. 6 and 7 depict a different and preferred embodiment of exercise apparatus 2. Like reference numerals indicate elements with similar functions but may differ in materials or mechanical design detail. Platform 4 is engaged and supported by integral inflatable support 26. In a preferred embodiment, inflatable support 26 is integrally formed from one continuous elastomeric polymeric structure. This may be accomplished in a single rotational molding process, for example. The elastomeric polymer used is similar to that used to form tubular supports 6 discussed earlier.

Inflatable support 26 includes upper portion 26A, lower portion 26B, and intermediate portion 26C at which upper portion 26A and lower portion 26B are joined. Upper portion 26A engages and supports platform 4 and has an outwardly curving outer surface having essentially a semicircular profile that tapers inwardly toward intermediate portion 26C. Lower portion 26B is for engaging and being supported by support surface 8 and has an outwardly curving outer surface having essentially a semicircular profile that tapers inwardly toward intermediate portion 26C. Platform 4 is preferably coupled to upper portion 26A utilizing coupling structures similar to those discussed with respect to FIGS. 3 and 4.

Upper portion 26A has a radial outside diameter 27A. Lower portion 26B has a radial outside diameter 27B that is greater than 27A in order to enhance stability of exercise apparatus 2. Intermediate portion 26C has a radial outside diameter 27C that is less than either 27A or 27B; thus intermediate portion 27C may be referred to as narrowed intermediate portion 27C.

Figure 8:
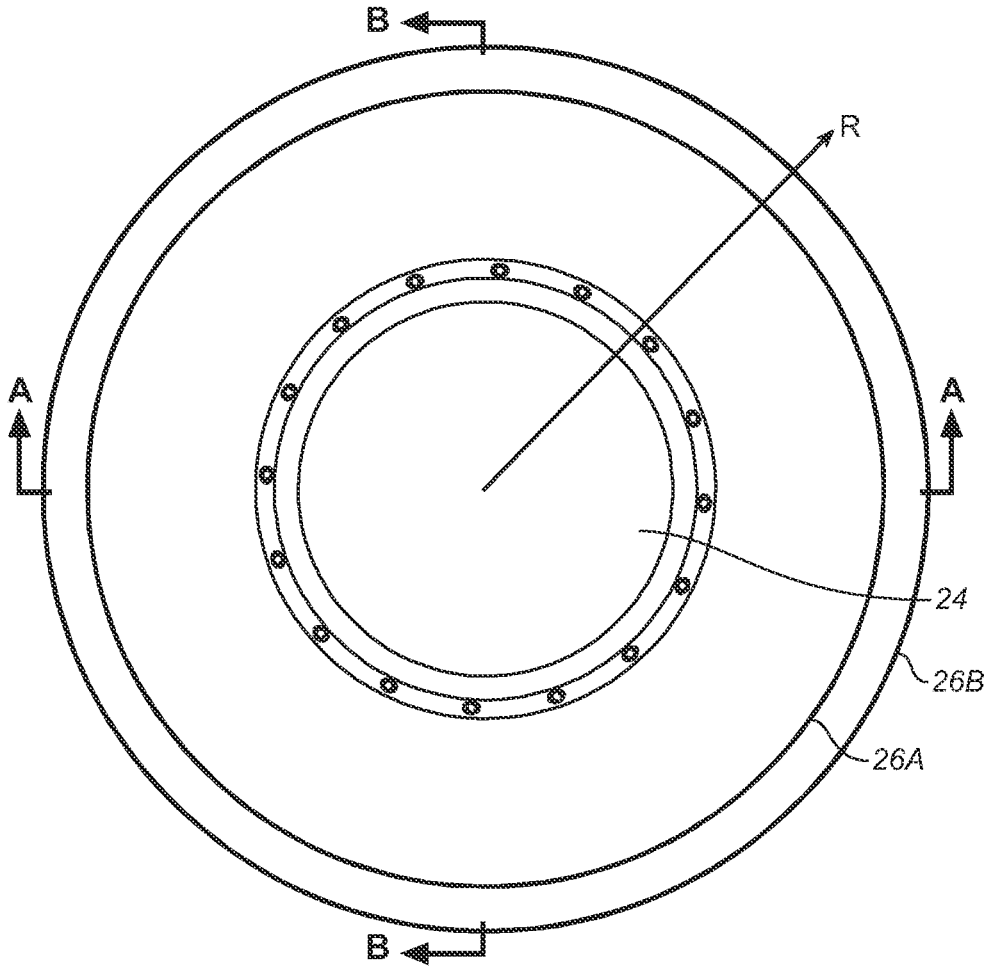
FIG. 8 depicts a top view of an inflatable support 26 in isolation.
Figure 9:
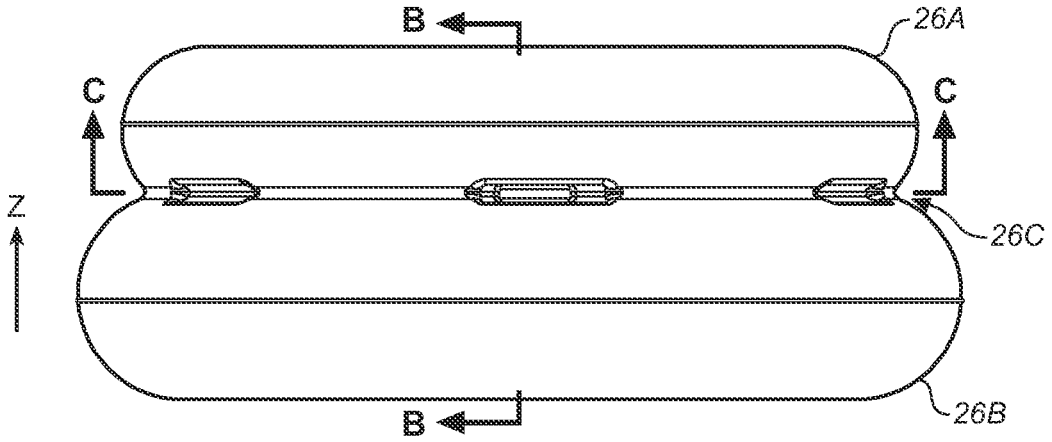
FIG. 9 depicts a side view of the inflatable support 26 of FIG. 6.

FIGS. 8-14 depict inflatable support 26 in isolation and in greater detail. FIG. 8 depicts a top view and FIG. 9 depicts a side view of inflatable support 26. FIGS. 8 and 9 include section lines A-A, B-B, and C-C that will later be referred to in discussing FIGS. 10-14. As illustrated, lower portion 26B has a larger radial outside diameter than does upper portion 26A. A central opening 24 passes through inflatable support 26 along a vertical axis (aligned with vertical axis Z shown in FIGS. 3 and 9).

Figure 10:
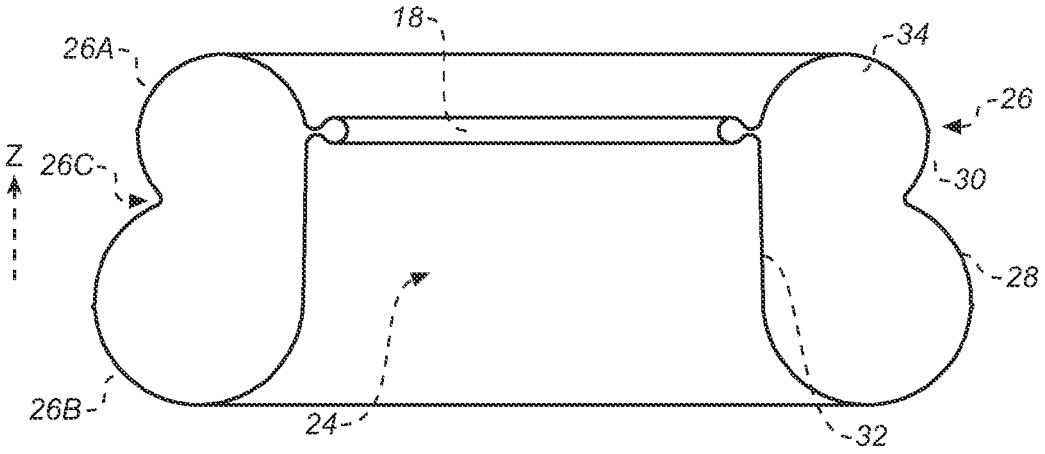
FIG. 10 depicts a cross-sectional view taken through A-A of FIG. 8.

FIG. 10 depicts a cross sectional view of inflatable support 26 taken through section line A-A of FIG. 8. Inflatable support 26 is formed from a continuous wall 28 having an outer peripheral wall portion 30 that defines the radial outside diameters 27A, 27B, and 27C (FIG. 7) and an inner wall portion 32. Inside of continuous wall 28 is an internal air chamber 34 that is pressurized using methods similar to those discuss earlier for tubular supports 6 of FIGS. 1-3. Inner wall portion 32 of continuous wall 28 separates the internal air chamber 34 from central opening 24. While inner wall portion 32 is depicted as being a vertical cylindrical wall, it is to be understood that inner wall portion will typically have a vertically varying curvature. Extending inwardly from inner wall portion 32 and into opening 24 is annular affixing member 18. When exercise apparatus 2 is assembled (FIGS. 6 and 7), affixing member 18 is used to secure inflatable support 26 to platform 4 in a manner similar to that discussed with respect to FIG. 4.

Figure 11:
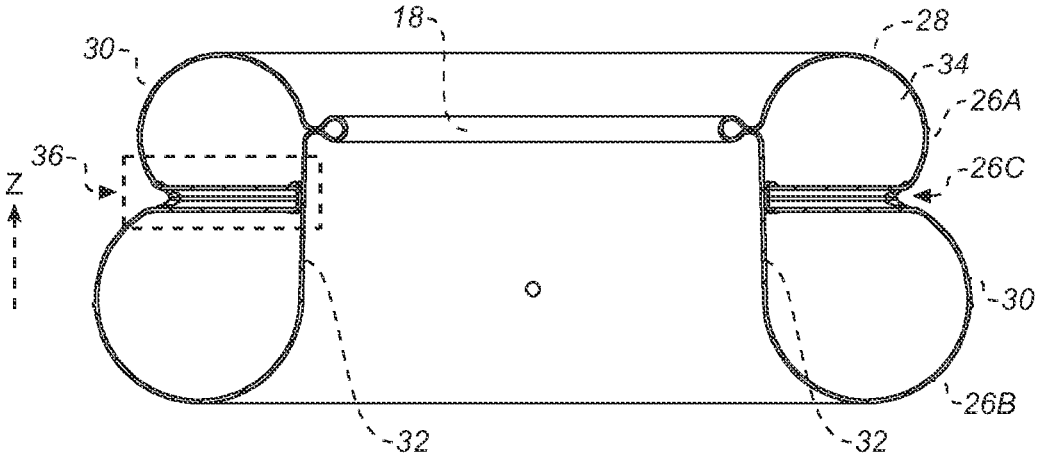
FIG. 11 depicts a cross-sectional view taken through B-B of FIG. 8 or FIG. 9.

FIG. 11 is a cross sectional view of inflatable support 26 taken through section line B-B of FIG. 8 and FIG. 9. This view illustrates support features 36 that couple the outer peripheral wall portion 30 to the inner wall portion 32 of wall 28. Intermediate portion 26C of inflatable support 26 include the support features 36. The support features 36 provide a radial support that resists radial expansion of intermediate portion 26C during inflation of inflatable support 26 and/or use of exercise apparatus 2.

Figure 12:
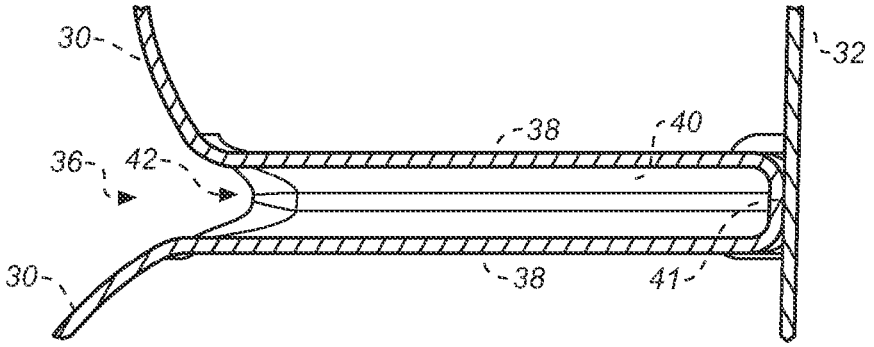
FIG. 12 is a detailed cross-sectional view taken from FIG. 11 illustrating a support feature.

FIG. 12 is a detailed portion of FIG. 11 depicting a single support feature 36. Support feature 36 includes connecting wall portions 38 that couple outer peripheral wall portion 30 with inner wall portion 32. In the illustrated embodiment, the connecting wall portions 38 form a cavity 40. The cavity 40 has an opening 42 formed in the outer peripheral wall portion 30 and a terminus 41 at inner wall portion 32. In preferred embodiment the terminus 41 of cavity 40 is defined by inner wall portion 32. In the illustrated embodiment, the connecting wall portions 38 extend in a substantially radial direction from the outer peripheral wall portion 30 to the inner wall portion 32.

Figure 13:
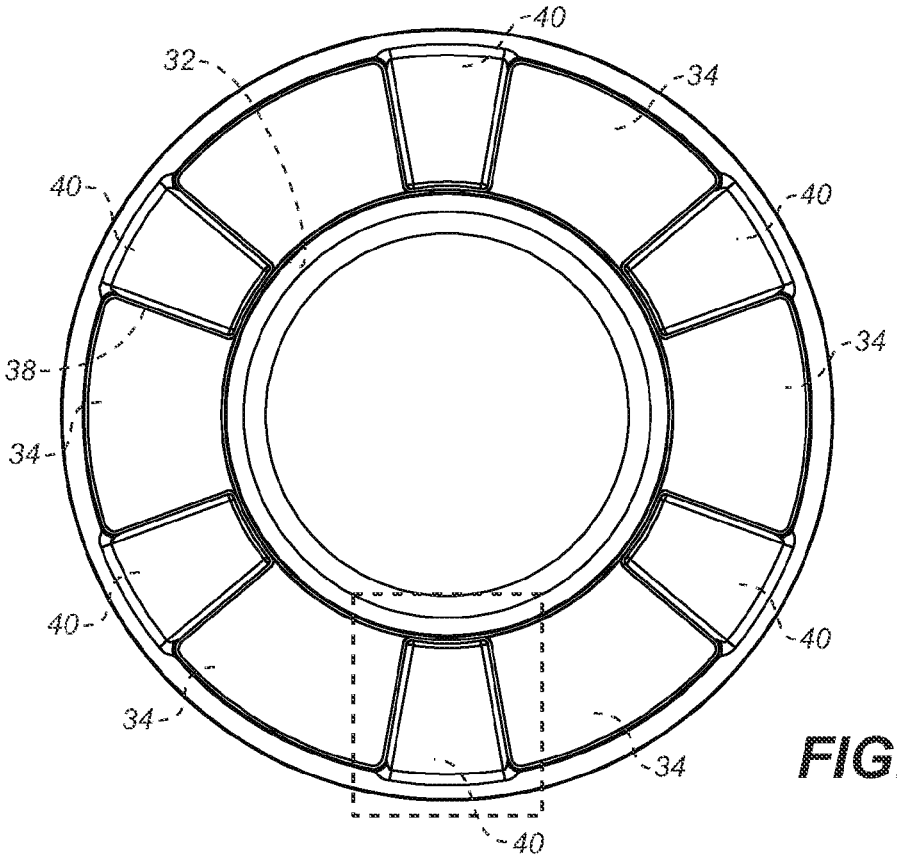
FIG. 13 is a cross-sectional view taken through C-C of FIG. 9.

FIG. 13 is a cross sectional view taken through C-C of FIG. 9 depicting a lateral (constant Z) cross section of intermediate portion 26C of inflatable support 26. Portions of internal chamber 34 and cavities 40 have an alternating circular arrangement around intermediate portion 26C. This arrangement provides enough support to prevent any portion of intermediate portion 26C from bulging excessively from an air pressure increase within internal chamber 34. Note that the portions of internal chamber 34 are all connected above and below intermediate portion 26C so that internal chamber 34 is continuous within wall 28.

In the embodiment illustrated in FIG. 13, there are six cavities 40 in a circular arrangement around intermediate portion 26C. However, it is to be understood that fewer or more of such cavities 40 can be deployed. Having more cavities 40 provides greater support to intermediate portion 26C but increases the difficulty in forming inflatable support 26.

Figure 14:
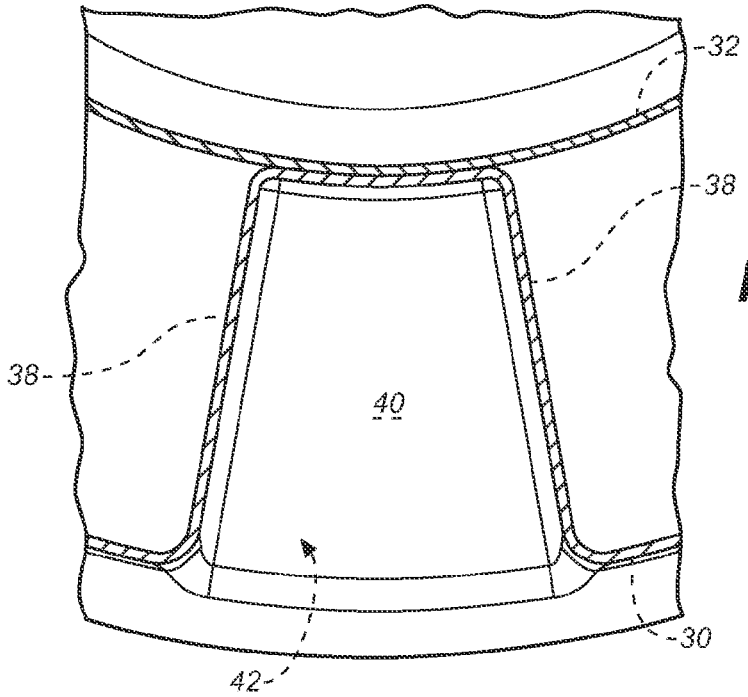
FIG. 14 is a detailed cross-sectional view taken from a portion of FIG. 13 illustrating a single cavity.

FIG. 14 depicts one of the outer cavities 40 in greater detail. Each cavity extends from an opening 42 in outer peripheral wall portion 30 toward inner wall portion 32. Opening 42, connecting wall portions 38, and inner wall portion 32 bound each cavity 40. Connecting wall portions 38 couple the outer peripheral wall portion 30 to the inner wall portion 32 to resist radially directed bulging of outer peripheral wall portion 30.

Figure 15:
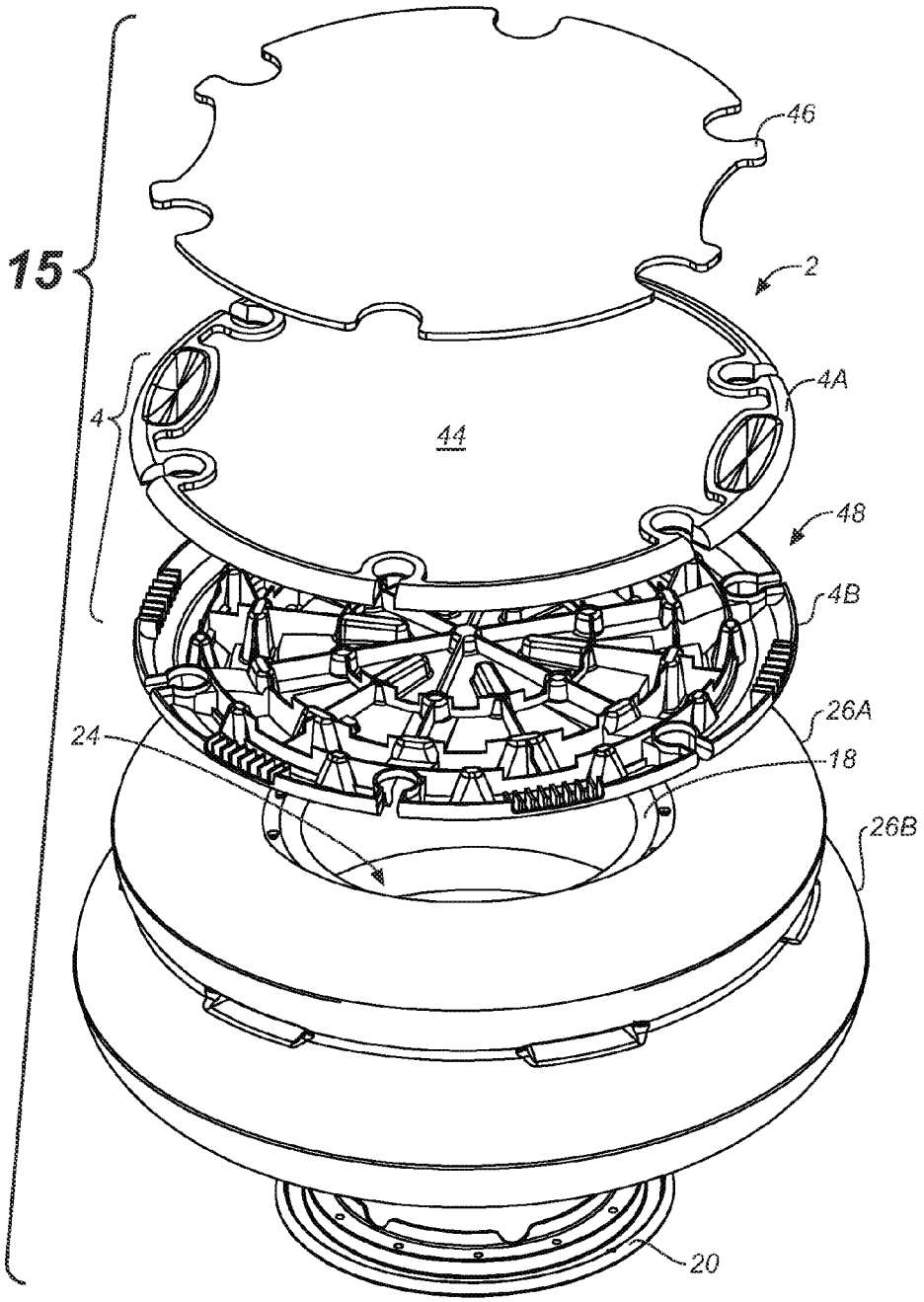
FIG. 15 is an exploded assembly view of a preferred embodiment of an exercise apparatus.

FIG. 15 depicts an exploded assembly diagram of the preferred embodiment of exercise apparatus 2. In this preferred embodiment platform 4 includes upper 4A and lower 4B portions. To an upper surface 44 of upper portion 4A is affixed a resilient pad 46 for user comfort. Lower portion 4B of platform 4 is coupled to inflatable support 26 via annular affixing member 18 and a ring shaped fastener 20 in a manner similar to that discussed with respect to FIGS. 3 and 4.

Lower portion 4B of platform 4 includes features such as ribs, fins, or ridges utilized to rigidify platform 4. Lower portion 4B also cooperates with upper portion 4A to provide a manifold or venting structure 48 to allow air to escape from an enclosed volume of central opening 24 that is trapped between platform 4 and support surface 8 (FIG. 1) when the enclosed volume is compressed.

Figure 16:
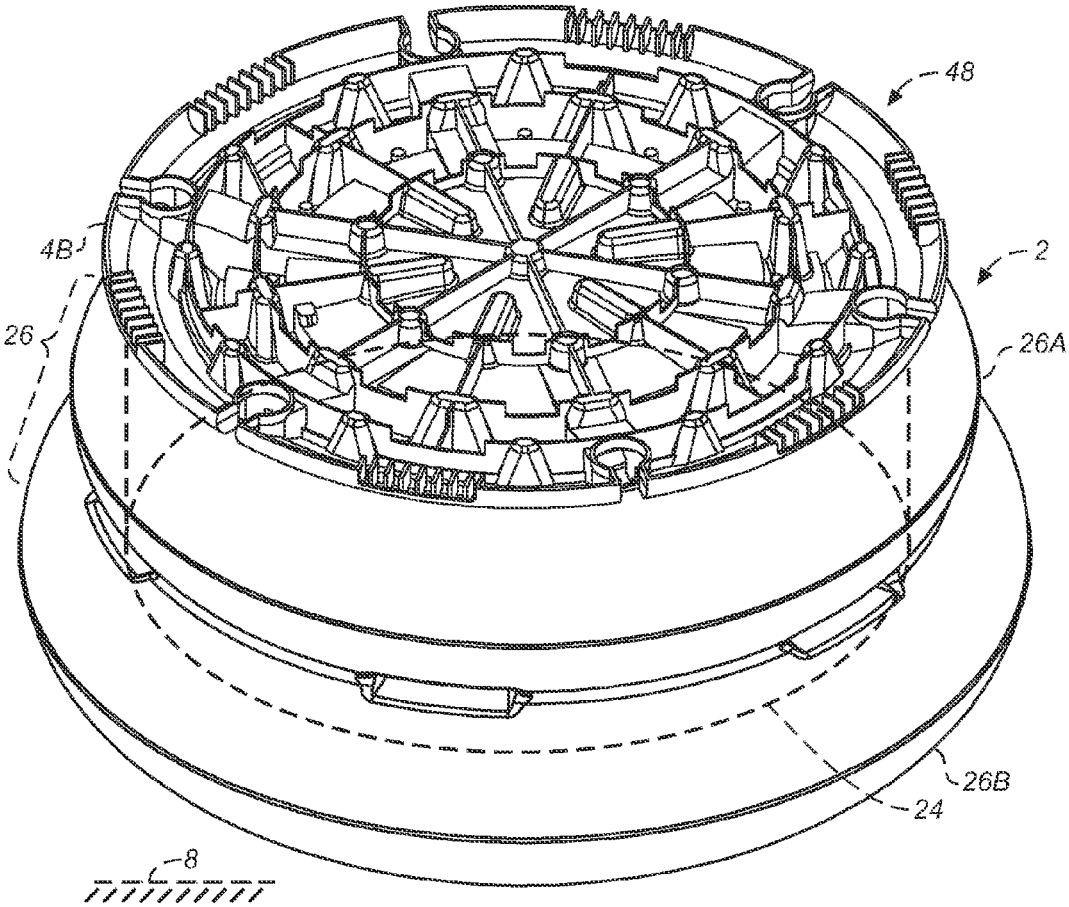
FIG. 16 is a perspective view of a preferred embodiment of an exercise apparatus with an upper portion of a platform removed to illustrate features between the upper and lower portions of the platform.
Figure 17:
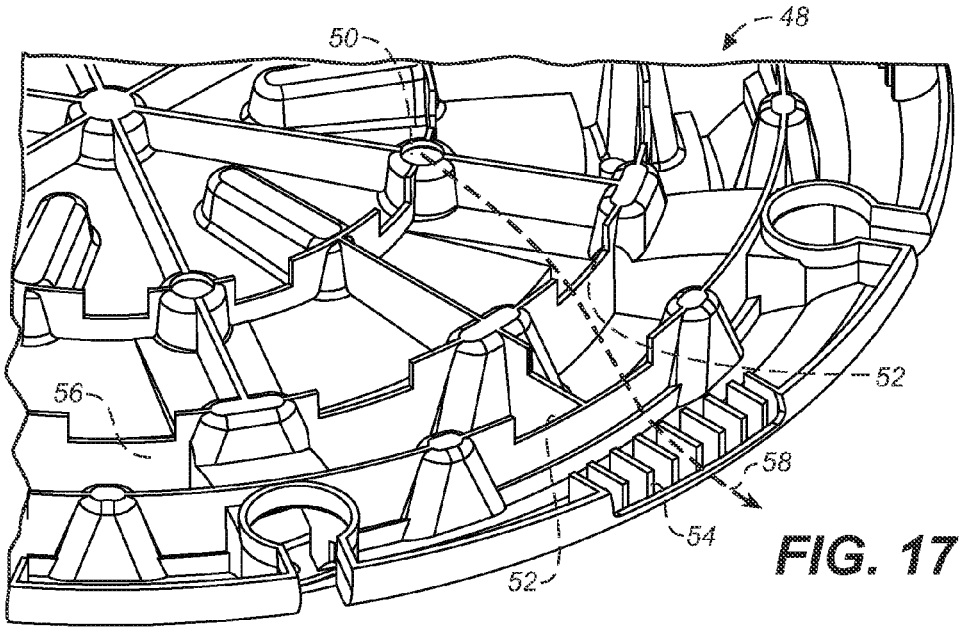
FIG. 17 is a detailed view taken from FIG. 16 illustrating details of a manifold or venting structure formed between the upper and lower portions of the platform.

FIG. 16 is a perspective view depicting exercise apparatus 2 with top portion 4A of platform 4 removed to allow manifold 48 to be viewed. FIG. 17 depicts a detailed portion from FIG. 16 to allow the manifold 48 to be viewed in greater detail. In FIG. 16, central opening 24 is disposed between support surface 8, inflatable support 26, and a lower surface of the lower portion 4B of platform 4.

Venting structure 48 includes vertical ducts 50, notches 52, and vents 54. Vertical ducts 50 couple central opening 24 to the manifold 48. Notches 52 are reduced height portions of ribs 56 that provide strength and rigidity for platform 4. Vents 54 form openings in the peripheral edges of platform 4.

A flow 58 of air through the vent structure occurs when the enclosed volume of central opening 24 is reduced. Air passes vertically in a positive Z direction through the vertical ducts 50 to the manifold 48. Then the air passes laterally (substantially constant Z) and mostly radially outwardly through the manifold 48. It passes through notches 52 before reaching vents 54. The air then passes radially outward from the vents 54 in the peripheral edges of platform 4.

Having an effective manifold or venting structure 48 eliminates a "hydroplaning effect" in which exercise apparatus 2 may move along support surface 8 in an unwanted manner during exercise in which a user's body weight is applied to platform 4. The vent structure 48 also helps a user deflate the inflatable support 26. By having the air pass radially outwardly, the user of exercise apparatus 2 will not receive an upward "blast" from the compressed air.

Figure 18:
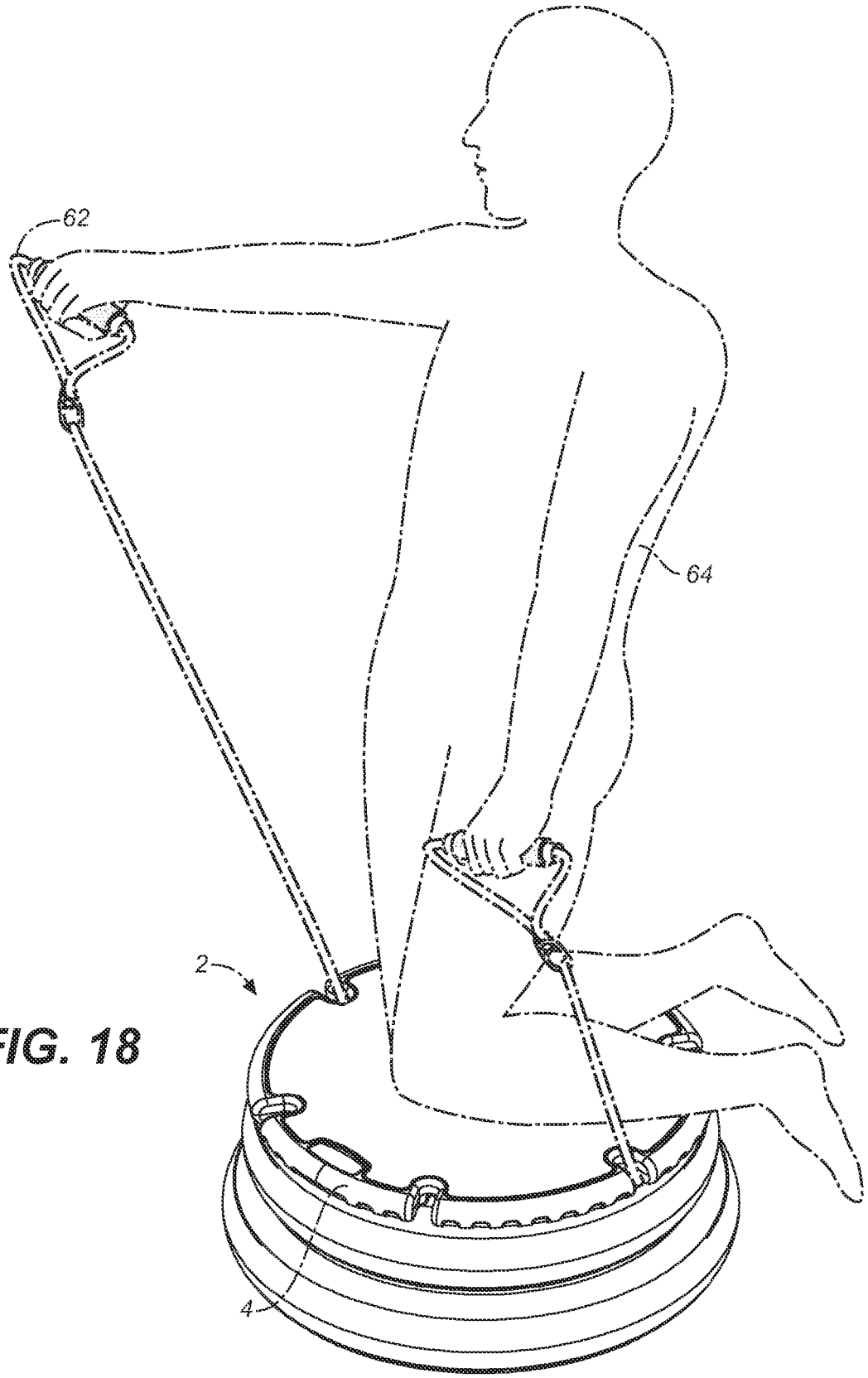
FIG. 18 is a perspective view of a user that is utilizing an exercise apparatus 2.

FIG. 18 depicts use of exercise apparatus 2 having exercise straps or cables 60 each having hand grips 62. The cables or exercise straps 60 along with an attachment point or retracting mechanism (not shown) within exercise apparatus 2 provide a mechanical resistance as handles 62 are raised a distance above exercise apparatus 2 by user 64.

Figure 19:
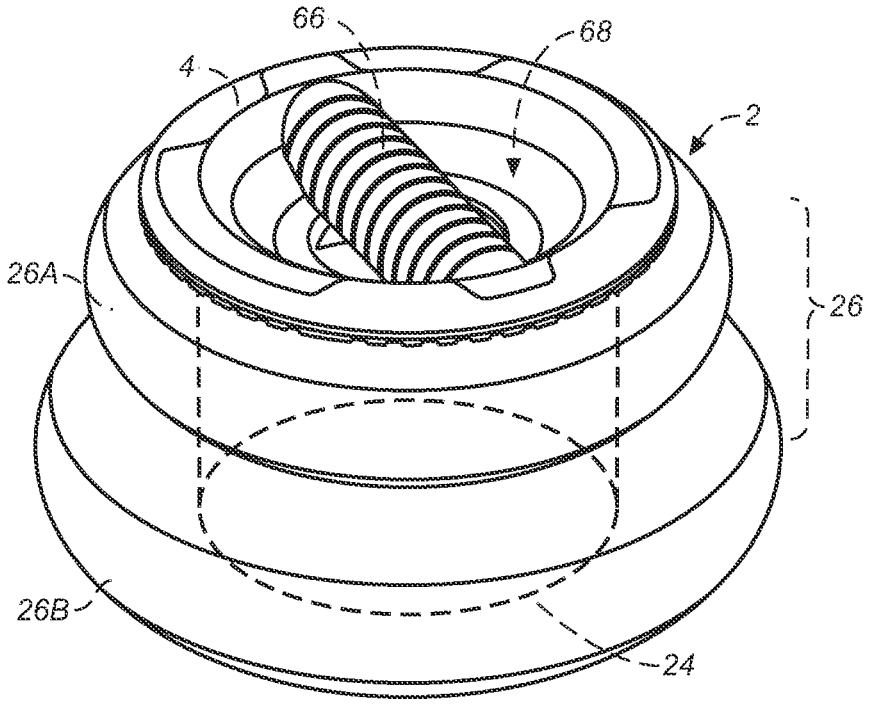
FIG. 19 illustrates a perspective view of an exercise apparatus of FIG. 6 with a centered hand grip.

FIG. 19 depicts an embodiment of exercise apparatus 2 configured as a "pushup" device 2. Pushup device 2 includes inflatable support 26 supporting rigid platform 4 having handgrip 66. In use there will usually be two such pushup devices 2, one for a left hand and one for a right hand of a user. In the illustrated embodiment rigid platform 4 includes an opening 68 that allows clearance for the user's hand. The opening 68 may be in fluid communication with opening 24 to allow for venting of the opening 24. Alternatively the openings 68 and 24 may not be in fluid communication and a vent structure 48 similar to that discussed with respect to FIGS. 16 and 17 may be formed into platform 4. Except for a smaller physical size and for handgrip 66 the pushup device 2 of FIG. 19 may be similar in construction to the exercise apparatus discussed supra.

In various embodiments, the exercise apparatus 2 has applications for aerobics, step aerobics, weight training with dumbbells, abdominal workouts, balance training, plyometric exercises, martial arts training, playing combat games and competitions, and muscle development with disabled children. Plyometric exercise is a training exercise designed to produce fast, powerful movements and to improve the functions of the nervous system, generally for the purpose of improving performance in sports.

The specific embodiments and applications thereof described above are for illustrative purposes only and do not preclude modifications and variations encompassed by the scope of the following claims.

We claim:

1. An exercise apparatus comprising:

a substantially rigid platform for supporting body weight during exercise;

an inflatable tubular support having a wall surrounding an internal air chamber having an outer peripheral wall portion and an inner wall portion, the inner wall portion separates a central opening from the internal air chamber, the wall defining an integral flange extending from the wall; and a fastener that couples the integral flange to the substantially rigid platform, the rigid platform and the fastener together define a channel, the integral flange has a relatively wider portion and a relatively narrower portion whereby the integral flange is mechanically captured in an interlocking manner within the channel.

2. The exercise apparatus of claim 1 wherein the integral flange includes two fastener flanges.

3. The exercise apparatus of claim 2 wherein the fastener includes two flange retainers each configured to clamp one of the fastener flanges to the rigid platform.

4. The exercise apparatus of claim 1 wherein the integral flange extends inwardly from the inner wall portion and into the opening.

5. The exercise apparatus of claim 1 wherein the integral flange extends outwardly from the outer peripheral wall portion.

6. The exercise apparatus of claim 1 wherein a venting structure is defined by the substantially rigid platform whereby air from the central opening is vented laterally outwardly from a peripheral edge of the platform.

7. An exercise apparatus comprising:

a substantially rigid platform for supporting body weight during exercise;

an inflatable tubular support having a wall surrounding an internal air chamber having an outer peripheral wall portion and an inner wall portion, the inner wall portion separates a central opening from the internal air chamber, the wall defining an integral flange; and a fastener that couples the integral flange to the substantially rigid platform wherein the fastener includes a flange retainer, a threaded hole is formed into the platform that receives a flange bolt whereby the flange retainer and threaded bolt clamp the integral flange to the platform.

8. An exercise apparatus comprising:

a substantially rigid platform for supporting body weight during exercise;

an inflatable tubular support supporting the substantially rigid platform and having a wall surrounding an internal air chamber having an outer peripheral wall portion and an inner wall portion, the inner wall portion separates a central opening from the internal air chamber whereby the central opening extends from a lower portion of the substantially rigid platform through the inflatable tubular support and to a support surface below the inflatable tubular support;

a fastener flange extending from the wall; and a fastener that couples the fastener flange to the substantially rigid platform.

9. The exercise apparatus of claim 8 wherein the fastener flange includes two fastener flanges.

10. The exercise apparatus of claim 9 wherein the fastener includes two flange retainers each configured to clamp one of the fastener flanges to the rigid platform.

11. The exercise apparatus of claim 8 wherein the fastener flange is ring shaped.

12. An exercise apparatus comprising:

a substantially rigid platform for supporting body weight during exercise;

an inflatable tubular support having a wall surrounding an internal air chamber having an outer peripheral wall portion and an inner wall portion, the inner wall portion separates a central opening from the internal air chamber;

a fastener flange formed into the inner wall portion; and a fastener that couples the fastener flange to the substantially rigid platform wherein the fastener includes a flange retainer, a threaded hole is formed into the platform that receives a flange bolt whereby the flange retainer and threaded bolt clamp the fastener flange to the platform.

13. An exercise apparatus comprising:

a substantially rigid platform for supporting body weight during exercise the platform defining a flange recess;

an inflatable tubular support having a wall surrounding an internal air chamber having an outer peripheral wall portion and an inner wall portion, the inner wall portion separates a central opening from the internal air chamber;

a fastener flange formed into the wall of the tubular support and received into the flange recess; and a fastener that clamps the rigid platform support to the fastener flange wherein the fastener includes a fastener retainer that is received into the flange recess and the flange recess includes a threaded hole that receives a flange bolt whereby the flange bolt and flange retainer clamp the fastener flange into the flange recess.

14. The exercise apparatus of claim 13 wherein the platform defines two flange recesses, the fastener flange includes two fastener flanges each received into one of the flange recesses.

15. The exercise apparatus of claim 14 wherein the fastener includes two flange retainers each configured to be received into one of the flange recesses.

16. The exercise apparatus of claim 13 wherein the flange recess is an annular channel.

* * * * *